US008528513B2

(12) United States Patent
Haug et al.

(10) Patent No.: US 8,528,513 B2
(45) Date of Patent: Sep. 10, 2013

(54) CAST STEEL PISTON FOR INTERNAL COMBUSTION ENGINES

(75) Inventors: Tilmann Haug, Weissenhorn (DE); Wolfgang Rehm, Ulm (DE); Karl Weisskopf, Rudersberg (DE)

(73) Assignee: Daimler AG, Stuttgart (DE)

( * ) Notice: Subject to any disclaimer, the term of this patent is extended or adjusted under 35 U.S.C. 154(b) by 805 days.

(21) Appl. No.: 12/302,723

(22) PCT Filed: Jun. 12, 2007

(86) PCT No.: PCT/EP2007/005155

§ 371 (c)(1),
(2), (4) Date: Nov. 26, 2008

(87) PCT Pub. No.: WO2008/000347

PCT Pub. Date: Jan. 3, 2008

(65) Prior Publication Data

US 2009/0178640 A1 Jul. 16, 2009

(30) Foreign Application Priority Data

Jun. 30, 2006 (DE) ..... 10 2006 030 699

(51) Int. Cl.

| | |
|---|---|
| ***F02F 3/00*** | (2006.01) |
| ***F01P 1/04*** | (2006.01) |
| ***C22C 38/18*** | (2006.01) |
| ***C22C 38/58*** | (2006.01) |

(52) U.S. Cl.
USPC ..... 123/193.6; 123/41.35; 148/327; 420/58; 420/60

(58) Field of Classification Search
USPC ..... 123/193.6, 41.35; 29/888.04, 888.042, 29/888.044, 527.5; 92/208; 164/97, 98, 164/108, 120, 900, 119, 306, 137, 340, 369; 72/364, 377, 359; 148/327; 420/58, 60
See application file for complete search history.

(56) References Cited

U.S. PATENT DOCUMENTS 2,177,454 A * 10/1939 Foley et al. ..... 420/34
3,165,400 A * 1/1965 Roy et al. ..... 420/12

(Continued)

FOREIGN PATENT DOCUMENTS

DE 726157 A1 10/1942
DE 3643039 A1 6/1988

(Continued)

OTHER PUBLICATIONS

Chao, C.Y et al. "ScienceDirect—Scripta Metallurgica et Materialia" vol. 25, Issue 7, Abstract First publication date: Jul. 7, 1991, available online Apr. 17, 2003, internet print dated Aug. 8, 2011 from www website: http://sciencedirect.com/science/article/pii/0956716X9190464C).

(Continued)

*Primary Examiner* — Thanh Truong
*Assistant Examiner* — Tea Holbrook
(74) *Attorney, Agent, or Firm* — Patent Central LLC; Stephan A. Pendorf

(57) ABSTRACT

The invention relates to a steel piston for internal combustion engines, comprising at least one piston upper part (12) provided with a combustion cavity (11) and an annular wall (5), and a piston lower part (13) provided with a connecting rod bearing (8). The steel piston is cast as a single component from a reduced-density steel alloy or a special steel alloy in the same material by means of a low-pressure casting method.

18 Claims, 3 Drawing Sheets

(56) References Cited

U.S. PATENT DOCUMENTS

| | | | | | |
|---|---|---|---|---|---|
| 3,431,100 | A | * | 3/1969 | Pecnik | 420/36 |
| 4,368,697 | A | * | 1/1983 | Moebus | 123/41.35 |
| 4,428,330 | A | * | 1/1984 | Shimizu | 123/41.35 |
| 4,494,988 | A | * | 1/1985 | Schumacher et al. | 420/73 |
| 4,586,553 | A | * | 5/1986 | Allen et al. | 164/97 |
| 4,712,600 | A | * | 12/1987 | Hamajima et al. | 164/97 |
| 4,832,107 | A | * | 5/1989 | Hass et al. | 164/98 |
| 4,907,545 | A | * | 3/1990 | Mills | 123/41.35 |
| 5,052,280 | A | | 10/1991 | Kopf et al. | |
| 5,342,678 | A | | 8/1994 | Ingus | |
| 5,620,043 | A | * | 4/1997 | Chamarro et al. | 164/119 |
| 5,954,113 | A | * | 9/1999 | Buchborn | 164/61 |
| 5,979,298 | A | * | 11/1999 | Whitacre | 92/211 |
| 6,032,619 | A | * | 3/2000 | Zhu et al. | 123/41.35 |
| 6,074,763 | A | * | 6/2000 | Rueckert et al. | 428/577 |
| 6,112,642 | A | | 9/2000 | Jarrett et al. | |
| 6,155,157 | A | * | 12/2000 | Jarrett | 92/186 |
| 7,255,755 | B2 | * | 8/2007 | Maziasz et al. | 148/327 |
| 7,356,925 | B2 | | 4/2008 | Bubeck | |
| 7,387,100 | B2 | * | 6/2008 | Fiedler et al. | 123/193.6 |
| 7,398,754 | B2 | * | 7/2008 | Tanihata et al. | 123/193.6 |
| 7,416,622 | B2 | | 8/2008 | Kueppers et al. | |
| 7,472,674 | B2 | * | 1/2009 | Robelet | 123/193.6 |
| 7,484,295 | B2 | * | 2/2009 | Appo | 29/888.045 |
| 7,503,304 | B2 | * | 3/2009 | Otsuka et al. | 123/193.6 |
| 7,628,134 | B2 | * | 12/2009 | Scharp | 123/193.6 |
| 7,767,033 | B2 | * | 8/2010 | Fujiwara et al. | 148/217 |
| 2001/0029840 | A1 | | 10/2001 | Gaiser et al. | |
| 2002/0110476 | A1 | * | 8/2002 | Maziasz et al. | 420/34 |
| 2003/0145911 | A1 | | 8/2003 | Hoffmann et al. | |
| 2003/0167918 | A1 | * | 9/2003 | Kemnitz et al. | 92/186 |
| 2004/0033154 | A1 | * | 2/2004 | Liang et al. | 420/10 |
| 2005/0005443 | A1 | * | 1/2005 | Arnold | 29/888.09 |
| 2005/0133187 | A1 | * | 6/2005 | Seaver et al. | 164/98 |
| 2007/0062479 | A1 | * | 3/2007 | Tanihata et al. | 123/193.6 |
| 2007/0125454 | A1 | | 6/2007 | Eipper et al. | |
| 2008/0000444 | A1 | * | 1/2008 | Hofmann et al. | 123/193.6 |
| 2008/0022962 | A1 | * | 1/2008 | Fujiwara et al. | 123/193.6 |
| 2010/0275873 | A1 | * | 11/2010 | Gniesmer et al. | 123/193.6 |

FOREIGN PATENT DOCUMENTS

| | | | |
|---|---|---|---|
| DE | 19701085 | A1 | 7/1998 |
| DE | 19901705 | A1 | 7/2000 |
| DE | 10128737 | A1 | 1/2003 |
| DE | 10338568 | A1 | 3/2005 |
| DE | 102004003980 | A1 | 8/2005 |
| DE | 69926583 | T2 | 1/2006 |
| EP | 0238146 | A2 | 9/1987 |
| EP | 1450080 | A1 | 8/2004 |
| EP | 1612395 | A1 | 1/2006 |
| GB | 1096826 | A | 12/1967 |
| GB | 2075550 | A | 11/1981 |
| JP | 5504175 | A | 7/1993 |
| JP | 5504789 | A | 7/1993 |
| JP | 2005504174 | A | 2/2005 |
| WO | 9103579 | A | 3/1991 |
| WO | 9103579 | A1 | 3/1991 |
| WO | 0210571 | A1 | 2/2002 |
| WO | 02088411 | A1 | 11/2002 |
| WO | 02101109 | A1 | 12/2002 |
| WO | WO 02101109 | A1 * | 12/2002 |
| WO | 03029504 | A2 | 4/2003 |
| WO | 2004000489 | A1 | 12/2003 |
| WO | 2004094808 | A1 | 11/2004 |
| WO | 2006014741 | A2 | 2/2006 |

OTHER PUBLICATIONS

Beitz, Wolfgang et al. "Dubbel—Taschenbuch für den Maschinenbau" (2001, vol. 20, p. 9) No Equivalent English Language Document Available.

* cited by examiner

CAST STEEL PISTON FOR INTERNAL COMBUSTION ENGINES

BACKGROUND OF THE INVENTION

1.Field of the Invention

The invention relates to a cast steel piston for internal combustion engines, which consists of a reduced-density steel alloy or of a high-grade steel alloy, or to a steel piston partially cast from ADI or GJV and partially formed from a reduced-density steel alloy or a high-grade steel alloy, and also to a method for producing a one-piece and materially unitary steel piston.

2.Description of the Related Art

On account of the increasing requirements with regard to as high peak pressures as possible in reciprocating internal combustion engines, which amount to up to 250 bar, lightweight aluminum pistons are increasingly reaching their performance limit. Steel pistons are therefore increasingly demanded again for the motor truck sector, but also for the passenger car sector. The stringent requirements in terms of useful life and reliability in this case make it necessary to have, in particular, pistons which are manufactured completely from steel and are to replace the steel and aluminum pistons still often used at the present time.

As compared with aluminum pistons, however, steel pistons have the disadvantage of a higher weight.

The production of pistons manufactured completely from steel is often complicated and costly because of the difficulty of processing steel for filigree components.

Thus, for example, it is customary to carry out the production of the piston by welding two forgings together.

As a result, the use of different materials for the upper part and lower part is also possible.

DE 102 44 513 A1 discloses a method for producing a multipart cooled piston. The piston upper part is manufactured from heat-resistant steel and the piston lower part from forged AFP steel. The subsequent joining or connecting of the annular rib of the piston upper part to the carrying rib of the piston lower part is carried out by means of a welding or soldering method. The preparation of the parts for joining and the joining method itself constitute cost-intensive method steps.

In EP 1612 395 A1, it is proposed to cast the entire piston from steel. It is proposed to use one of the two following steel compositions (in percent by mass) as the casting alloy:

C≦0.8%, Si≦3%, Mn≦3%, S≦0.2%, Ni≦3%, Cr≦6%, Cu≦6%, Nb 0.01-3%, the rest Fe, with unavoidable impurities, or C≦0.1-0.8%, S≦3%, Si≦3%, Mn≦3%, S≦0.2%, Ni≦10%, Cr≦30%, Cu≦6%, Nb≦0.05-8% and the rest Fe, with unavoidable impurities.

In this case, in particular, the good room temperature yield strength and also high high-temperature tensile strength and breaking strength play a part.

On account of the filigree type of construction of a piston, the flowability of the casting metal and also the casting method must satisfy particularly stringent requirements. The casting method and the flowability of the metal are of critical importance for achieving a suitable and fault-free structure which is indispensible for the high strength requirements of the cast components. Even minimal structural faults and shrinkage cavities in the casting may lead, in the thin walls of the piston, to a catastrophic material failure.

BRIEF SUMMARY OF THE INVENTION

The object of the invention, therefore, is to provide pistons consisting of lightweight steel which have high mechanical load-bearing capacity and can be formed cost-effectively. A further object according to the invention is to specify a cost-effective and simple method for producing these steel pistons.

The object is achieved, according to the invention, by means of a steel piston for internal combustion engines, which comprises at least one piston upper part with combustion recess and an annular wall and a piston lower part with connecting rod bearing, which is cast from a reduced-density steel alloy or from a high-grade steel alloy, as described in greater detail below, and by means of a steel piston which is cast only partially from a reduced-density steel alloy, a high-grade steel alloy, vermicular graphite (GJV) or austempered ductile iron (ADI). A further solution according to the invention is afforded by a method for producing a one-piece and materially unitary steel piston by means of a low-pressure casting method.

According to the invention, therefore, the steel piston is cast in one piece and in a materially unitary manner. An appreciable simplification of the production method is thereby achieved. It is consequently of essential importance to the invention to use steel alloys which can easily be processed in casting terms, to have high strength or a high yield strength at the high temperatures of use and to possess as low a material density as possible.

The first steel alloy used according to the invention is a reduced-density steel alloy of the following composition (the following particulars are in % by weight, unless specified otherwise)

Mn: 12-35
Al: 6-16
Si: 0.3-3
C: 0.8-1.1
Ti: up to 0.03

The rest Fe, and unavoidable steel companion elements.

This alloy is distinguished by a good flow capacity. Furthermore, the density of the material, at approximately 6.8 g/cm, is comparatively low. A further advantage of this alloy is based on the high-temperature corrosion resistance. The high Al content in this case contributes particularly to this corrosion resistance. Alloys of this type can also satisfy the high mechanical requirements.

Particularly preferably, the fraction of Mn and Al lies in the range of Mn 18-32% and A18-12%.

The further steel alloy used according to the invention is a high-grade steel alloy of very good flowability, with the following composition in % by weight:

Mn: 3-9
Si: 0.3-1
C: 0.01-0.03
Cr: 15-27
Ni: 1-3
Cu: 0.2-1
N: 0.05-0.17

The rest Fe, and unavoidable steel companion elements.

Preferably, the fraction of Mn and Cr lies in the range of Mn 4-6% and Cr 19-22%.

A further advantage of this alloy is outstanding erosion resistance at the high temperatures prevailing in the combustion space of internal combustion engines. On account of the high strength and good flowability, particularly thin or filigree structures of the piston are possible.

There is provision for the steel piston to be cast in one piece and in a materially unitary manner. What is to be understood by this is that the piston upper part with combustion recess and annular wall and a piston lower part with connecting rod bearing emanate from one casting and consist of the same material. This, however, is also to be understood as meaning steel pistons containing further built-on or built-in parts which may differ in terms of material from the cast piston or which are not formed during the operation of casting the piston. This further part had to be understood as meaning, for example, insertion parts which are cast on or cast in. Depending on the material and quality of the cast-in or cast-on piece, the applied or inserted parts may no longer be different from the steel piston, and therefore steel pistons and applied or insertion parts also seem to be cast in one piece and in a materially unitary manner.

BRIEF DESCRIPTION OF THE SEVERAL VIEWS OF THE DRAWINGS

To explain the invention, diagrammatic drawings are used. In these.

DETAILED DESCRIPTION OF THE INVENTION

Figure 1:
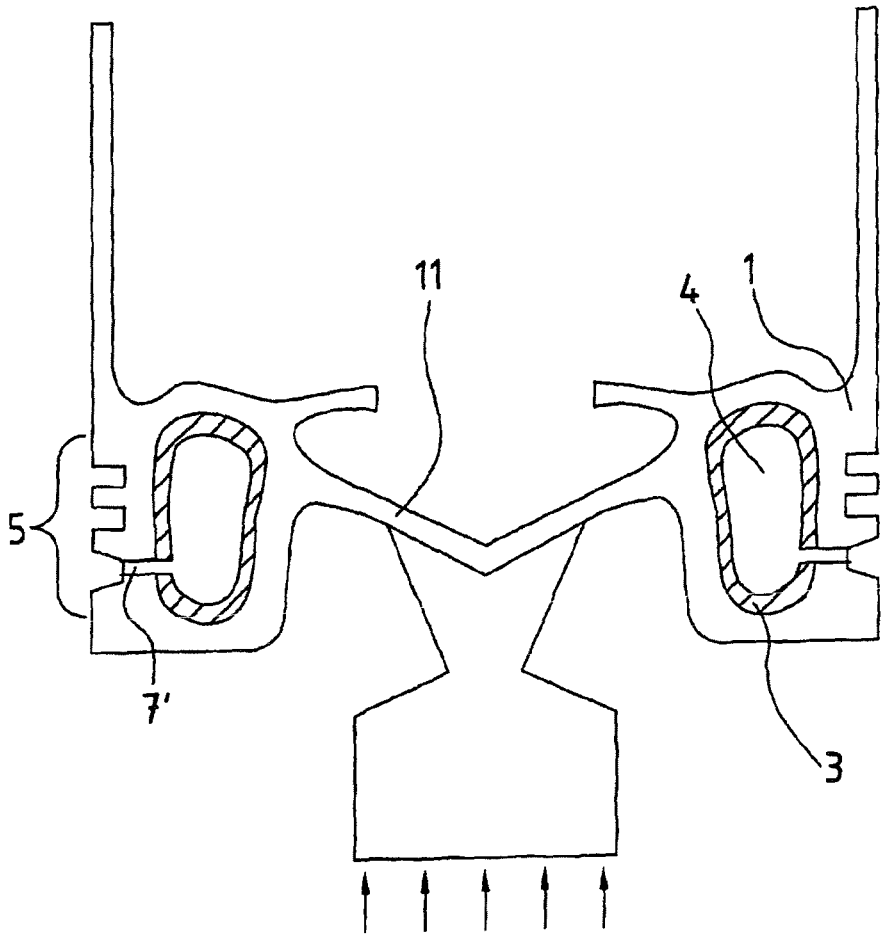
FIG. 1 shows a piston (1) in cross section, with a melt-in flow indicated with arrows, cast-in steel tube (3), cooling duct (4), annular wall (5), orifices (7') of the cooling duct to the annular wall, and annular grooves (10)
Figure 2:
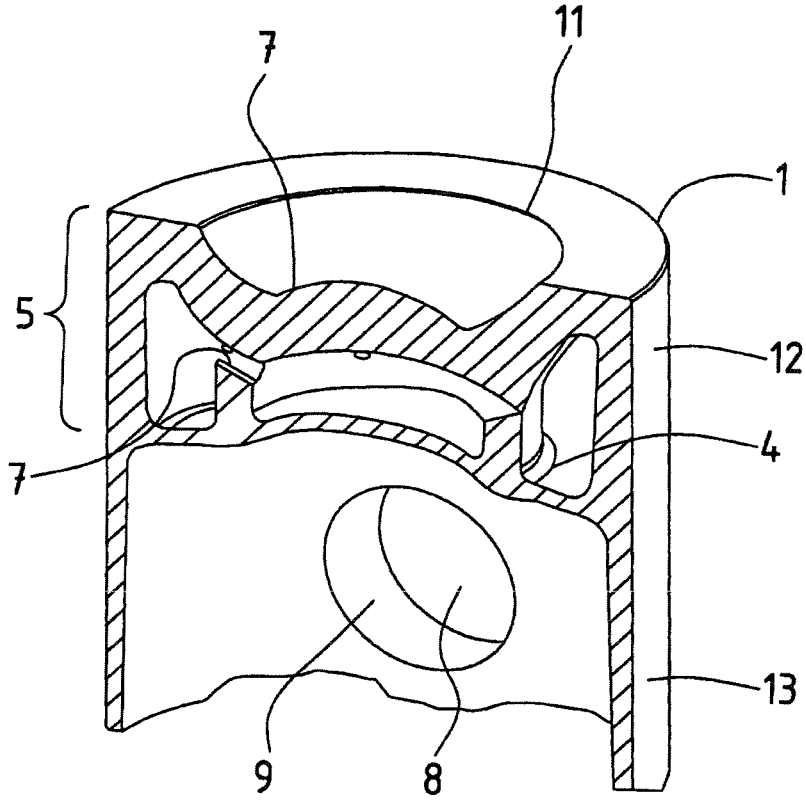
FIG. 2 shows a piston (1) in cross section, with an upper part (12) and lower part (13), annular wall (5), cooling duct (4), orifice (7) of the cooling duct, connecting rod bearing (8), connecting rod bearing wall (9) and combustion recess (11)

In a preferred version, the piston has one or more cooling ducts (4) in the piston upper part (12). The cooling duct may in this case be continuous or be divided into a plurality of segments. In the latter instance, even a plurality of cooling ducts may be referred to. The at least one cooling duct has perforations or orifices (7, 7') to the piston interior and/or to the annular wall (5).

The perforations or orifices (7) to the piston interior serve for exchange of coolant or oil. These are typically round orifices or bores. However, depending on requirements, other geometries may also be implemented. This can be carried out in a simple way, in particular, by means of the casting production method selected according to the invention, for example in that suitably formed casting cores or insertion parts are used. In this case, the drilling of orifices may be dispensed with.

Furthermore, the cooling duct (4) may also be interrupted toward the annular wall, so that an orifice (7') is obtained. So that the cooling duct (4) does not remain open outwardly with orifices to the annular wall (5), it is closed outwardly by means of at least one closing part (6). The cooling tube system thus has a multipart set-up. The closing part (6) is preferably formed by a metal sheet or closing sheet or a steel ring. For clamping, the closing part may in this case project into the cooling duct. The closing part is typically welded on or soldered on. The perforation or orifice (7') and the closing part (6) are preferably arranged in the region of or within an annular groove (10).

In a further preferred embodiment of the invention, the at least one cooling duct (4) is formed by a cast-in steel tube (3). As a rule, the steel tube cannot be identified, even in the cast steel piston, because of the irregularities in the structure which prevail in the boundary region or runner region. If the steel tube is coated, for example with Sn, before being cast in, for the purpose of better connection, a boundary region consisting of a mixed alloy is formed around the cooling duct (4).

In a further variant according to the invention, the cooling duct or cooling ducts (4) is or are formed completely by cast-in steel tubes (3), and the cooling ducts (4) have no orifice (7') toward the annular wall. They are closed outwardly and require no closing part (6). Here, too, orifices (7) are preferably present inwardly. The cooling tube system thus has a one-part set-up.

It is possible that the steel of the piston and the steel of the cast-in steel tube (3) have a different composition. Likewise, between the piston and cast-in steel tube, an intermediate layer may be formed which has a composition different from the steel of the piston. Preferably, the steel tubes are formed from high-melting steels or highly heat-resistant steels. There is no need to use easily castable steels.

The material of the cast-in steel tube may also comprise the proven steels from the group MoCr4, 42CrMo4, CrMo4 or 31CrMoV6.

In a further embodiment of the invention, the connecting rod bearing wall (9) has a bearing shell or the connecting rod bearing wall (9) is formed at least partially by a bearing shell which consists of a cast-in part. The cast-in part or the bearing shell thereby formed preferably consists of a highly wear-resistant steel. By virtue of the casting of the steel piston, as selected according to the invention, a particularly suitable material for a bearing shell can be introduced in a simple way by casting on. In particular, a steel from the group MoCr4, 42CrMo4, CrMo4 or 31CrMoV6 is selected as material for the bearing shell. The bearing shell may, if appropriate, also carry special sliding coatings.

In a further variant of the invention, it is not the entire piston which is cast in one piece and in a materially unitary manner, but only the piston upper part. According to the invention, a piston for internal combustion engines is provided, which comprises at least one piston upper part (12) with combustion recess (11) and annular wall (5) and a piston lower part (13) with connecting rod bearing (8), the piston lower part (13) being cast in one piece and in a materially unitary manner from a reduced-density steel alloy of the composition Mn: 18-35, Al: 8-12, Si: 0.3-3, C: 0.8-1.1, Ti: up to 0.03, the rest Fe, and unavoidable steel companion elements, or from a high-grade steel alloy with the composition Mn: 4-6, Si: 0.3-1, C: 0.01-0.03, Cr: 19-22, Ni: 1-3, Cu: 0.2-1, N: 0.05-0.17, the rest Fe, and unavoidable steel companion elements, or from austempered ductile iron, from cast iron with vermicular graphite (GJV) or from austenitic or alloyed cast iron with spheroidal graphite, and being connected by welding to the piston upper part (12) consisting of steel.

In this case, the piston upper part may be manufactured in a conventional way. The piston upper part (13) is preferably a forging.

The material of the piston upper part is not restricted to the steels of the lower part. Instead, the already proven steels may be adopted. The suitable steels include, inter alia, MoCr4, 42CrMo4, CrMo4 or 31CrMoV6.

Figure 3:
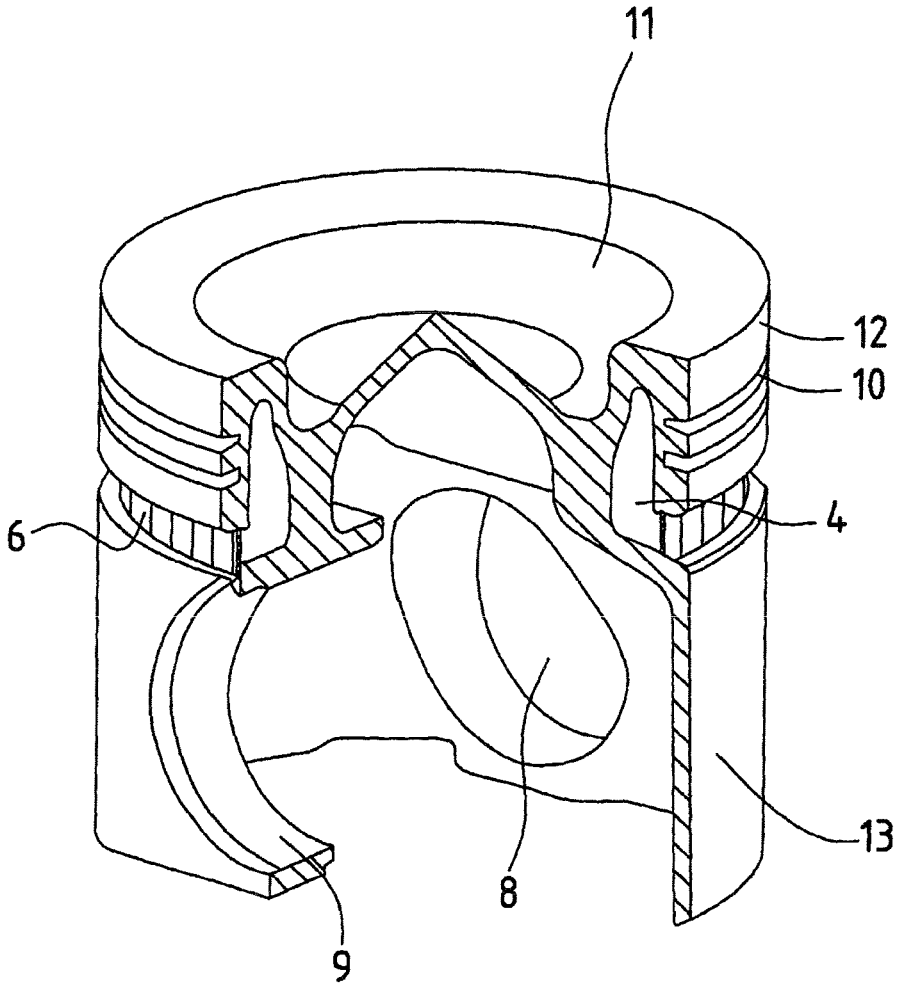
FIG. 3 shows a piston (1) in section, with an upper part (12) and lower part (13), annular wall (5), cooling duct (4), closing part (6), connecting rod bearing (8), connecting rod bearing wall (9) and combustion recess (11).

According to the invention, the joining of the piston upper part (12) and piston lower part (13) takes place by means of welding. Friction welding is particularly preferred. Depending on the configuration of the piston, the parting line between the upper and the lower part may run at a different height to the piston. The parting line is preferably arranged approximately at the lower end of the annular wall (5) (cf. FIG. 3).

The austempered ductile iron (ADI) of the piston lower part is also designated as bainitic/ferritic cast iron with spheroidal graphite. ADI is a low-distortion isothermally annealed cast iron with spheroidal graphite. It is distinguished by a highly beneficial combination of strength and extension and also a high fatigue limit under alternating stresses and a favorable wear behavior. The basic mass of the ADI is a bainite-like structure consisting of acicular carbide-free ferrite and carbon-enriched stabilized retained austenite without carbides.

In cast iron with vermicular graphite (often called GJV or GGV), the graphite is not present either in flaky form or in spheroidal form, but as vermicules. The mechanical properties of this material lie between those of cast iron with flaky graphite and those of cast iron with spheroidal graphite. Its production, however, is more difficult and requires a melt treatment managed within narrow tolerances.

Both the ADI material and the GJV or GJS material can be controlled more simply in casting terms than the steels listed above, but do not have their high mechanical load-bearing capacity. According to the invention, therefore, these materials are used only in the piston lower part where the mechanical and thermal loads are not as high as, for example, in the combustion recess (11) of the upper part (12).

This composite type of construction has the advantage that the ADI or GJV or GJS materials, which are more cost-effective than steels, can be used.

A further aspect of the invention relates to a particularly suitable method for producing a steel piston by casting.

The method according to the invention for producing a one-piece and materially unitary steel piston, which comprises at least one piston upper part (12) with combustion recess (11) and annular wall (5) and a piston lower part (13) with connecting rod bearing (8), provides for the use of a low-pressure casting method. In this case, the steel melt is pressed in a controlled manner from below by means of a riser into the molding cavity of the attached casting mold with an excess pressure of 0.3 to 5 bar, the casting of the piston taking place from below via the region of the piston recess (11). FIG. 1 shows diagrammatically the inflow (2) of the melt from below into the region of the piston recess (11).

The application according to the invention of the low-pressure casting method to steel melts is in this case of essential importance.

In the low-pressure casting method, a casting arrangement is selected in which the metal melt is pressed in a controlled manner from below, that is to say counter to gravitational force, by means of a riser into the molding cavity of the attached casting mold. The casting mold used may be a permanent mold or else sand casting molds. According to the complex form of the piston to be cast, it is expedient to combine the permanent mold with sand cores or to insert sand cores or core packages into the casting mold.

The pressure used in low-pressure casting is usually relatively low and ranges between 0.02 and 0.1 MPa, depending on the necessary rise height and the density of the casting material.

According to the invention, the casting pressure is at an excess pressure of approximately 0.3 to 5 bar. An accurate regulation of the casting pressure and of the pressure profile (pressure build-up, holding phase and follow-up pressure) is necessary for a uniform and shrinkage cavity-free mold filling. A pressure of 0.5 to 1.5 bar is preferably used.

The casting furnace and the permanent mold form a permanent mold casting unit connected by means of the riser. The casting furnace is closed off, pressure-tight, overall. The furnace serves preferably only for keeping the metal hot, not for melting it. In this case, the metal melt is cast with low turbulence into the casting mold from below by the action of pressure upon the keeping-hot furnace with a regulated casting pressure and a controlled casting speed. Instead of compressed air, an inert gas may also be used. The work is preferably carried out with nitrogen. The piston obtained continues to be fed via the prevailing casting pressure until the end of its solidification. A denser structure than in permanent mold casting or gravity casting is thereby achieved.

On account of the filigree form of the piston, in particular of the thin walls, as shrinkage cavity-free a casting as possible is of critical importance.

In a first embodiment, a feeder is dispensed with almost completely, since the feed takes place through the riser. So that this advantage can be utilized, the method is designed such that solidification takes place from above as far as a defined point directly above the riser, the metal remaining liquid in the riser. This may be achieved, for example, in that the riser is heated or receives special heat insulation. Furthermore, it is possible to cool the mold at special points solely or in addition to the heated riser. This is particularly effective when the casting mold is a permanent mold consisting of metal or graphite.

A further variant provides for the use of sand casting molds and for utilizing the advantages of rising mold filling, but of dispensing with the feed through the riser. Before the cast piston has solidified completely, the gate of the mold is closed. Thereupon, the pressure in the low-pressure casting furnace is lowered, and the melt runs out of the riser back into the furnace. The process time can thereby be shortened.

As compared with conventional casting methods, the low-pressure casting method also has the advantage that the temperature of the melt can be set exactly. The casting profile or the exact mold filling can thereby be calculated easily.

A further advantage of the low-pressure casting is that casting faults, such as gas inclusions due to a turbulent mold filling or cold running due to mold filling which is too slow, are prevented by means of an accurately controlled mold filling, in particular accurately controlled filling speed.

In the method according to the invention, a casting is formed which is in one piece and is materially unitary. If the steel piston has further special components, such as, for example, cooling ducts, there is the possibility that, in the finished piston, these are in one piece and materially unitary with the casting.

Particularly preferably, the following alloys particularly suitable in terms of material properties and of castability are used as casting metal:

Reduced-density steel alloy of the following composition,

Mn: 18-35
Al: 8-12
Si: 0.3-3
C: 0.8-1.1
Ti: up to 0.03

The rest Fe, and unavoidable steel companion elements.

High-grade steel alloy with the following composition:

Mn: 4-6
Si: 0.3-1
C: 0.01-0.03
Cr: 19-22
Ni: 1-3
Cu: 0.2-1
N: 0.05-0.17

The rest Fe, and unavoidable steel companion elements.

In a preferred embodiment of the invention, one or more insertion parts to form special components of the piston are inserted into the casting mold. In this case, in contrast to the sand cores which can likewise be used in casting, insertion parts are to be understood as meaning parts which remain in the cast piston.

The insertion parts are in this case expediently made from steel, since here there is good material compatibility with the steel of the piston. Particularly preferably, by means of the insertion parts, at least one cooling duct (4) and/or a connecting rod bearing wall (9) are formed. For this purpose, steel tubes (3) or steel shells are correspondingly inserted into the casting mold. The insertion parts are preferably an integral part of sand core packages.

The steel tube may also be a sand-filled tube. A uniform premolding of the tube is possible by means of the sand filling of the tube. In casting, the sand filling prevents an unintentional breakthrough of the melt due to the partial melting open of the tube.

Particularly preferably, the steel tube is then filled with molding sand when it has an orifice (7') to the annular wall (5) or large orifices (7) to the piston interior.

The orifices (7) to the piston interior may be introduced by casting and/or by the later machining of the casting. By contrast, the orifice (7') to the annular wall (5) is expediently formed during casting, since the large orifice allows an easy and complete removal of core sand contained in the steel tube.

The invention claimed is:

1. A steel piston for internal combustion engines, which comprises at least one piston upper part (12) with combustion recess (11) and annular wall (5) and a piston lower part (13) with connecting rod bearing (8), wherein the steel piston is cast in one piece and in a materially unitary manner from a high-grade steel alloy consisting of in % by weight Mn: 3-9
Si: 0.3-1
C: 0.01-0.03
Cr: 15-27
Ni: 1-3
Cu: 0.2-1
N: 0.05-0.17
the rest Fe, and unavoidable steel companion elements.

2. The steel piston as claimed in claim 1, wherein the piston has in the piston upper part (12) one or more cooling ducts (4) which have at least partially perforations or orifices (7, 7') to at lest one of (a) the piston interior and (b) the annular wall (5).

3. The steel piston as claimed in claim 2, wherein the at least one cooling duct (4) is formed by a cast-in steel tube (3).

4. The steel piston as claimed in claim 3, wherein the steel of the piston and the steel of the cast-in steel tube (3) have a different composition, or, between the piston and cast-in steel tube, an intermediate layer is formed which has a composition different from the steel of the piston.

5. The steel piston as claimed in claim 1, wherein the cooling ducts (4) with orifices to the annular wall (5) are closed off outwardly by means of at least one closing part (6).

6. The steel piston as claimed in claim 5, wherein the closing part (6) is formed by a metal sheet or steel ring.

7. The steel piston as claimed in claim 1, wherein cooling ducts (4) have no orifice (7') toward the annular wall and are formed completely by cast-in steel tubes (3).

8. The steel piston as claimed in claim 1, wherein the connecting rod bearing wall (9) has a bearing shell which is formed by a cast-in part.

9. The steel piston as claimed in claim 8, wherein the cast-in part of the bearing shell is formed by a highly wear-resistant steel.

10. The steel piston as claimed in claim 1, wherein the cast-in part of the bearing shell or the cast-in steel tube (3) is formed from a steel of the group MoCr4, 42CrMo4, CrMo4 or 31CrMoV6.

11. A steel piston for internal combustion engines, which comprises at least one piston upper part (12) with combustion recess (11) and annular wall (5) and a piston lower part (13) with connecting rod bearing (8), wherein the piston lower part (13) is cast in one piece and in a materially unitary manner from a high-grade steel alloy consisting of in % by weight
Mn: 4-6
Si: 0.3-1
C: 0.01-0.03
Cr: 19-22
Ni: 1-3
Cu: 0.2-1
N: 0.05-0.17
the rest Fe, and unavoidable steel companion elements,
or from austempered ductile iron,
or from cast iron with vermicular graphite (GJV), or from GJS, and is connected by welding to the piston upper part (12) consisting of steel.

12. The steel piston as claimed in claim 11, wherein the piston upper part (13) is a forging.

13. The steel piston as claimed in claim 11, wherein the piston upper part (12) and the piston lower part (13) are connected to one another by friction welding.

14. A method for producing a one-piece and materially unitary steel piston, which comprises at least one piston upper part (12) with combustion recess (11) and annular wall (5) and a piston lower part (13) with connecting rod bearing (8), wherein a low-pressure casting method is used, in which a steel melt is pressed in a controlled manner from below by means of a riser into the molding cavity of the attached casting mold with an excess pressure of 0.3 to 5 bar, the casting of the piston taking place from below via the region of the piston recess (11), wherein the steel is selected from a high-grade steel alloy consisting of in % by weight Mn: 4-6
Si: 0.3-1
C: 0.01-0.03
Cr: 19-22
Ni: 1-3
Cu: 0.2-1
N: 0.05-0.17
the rest Fe, and unavoidable steel companion elements.

15. The method as claimed in claim 14, wherein one or more insertion parts consisting of steel are inserted into the casting mold in order to form at least one cooling duct and the connecting rod bearing wall (9).

16. The method as claimed in claim 15, wherein a closed steel tube (3) or a partially open steel tube (3) filled with core sand is inserted in order to form a cooling duct (4).

17. The method as claimed in claim 14, wherein at least one casting core or core package is inserted into the casting mold in order to form cooling ducts (4).

18. The method as claimed in claim 17, wherein the core package has insertion parts consisting of steel.

* * * * *